United States Patent [19]

Gentry

[11] 4,030,172

[45] June 21, 1977

[54] CRANKSHAFT-FORMING APPARATUS AND METHOD

[76] Inventor: Elvin O. Gentry, 1419 Towanda St., Bloomington, Ill. 61701

[22] Filed: July 8, 1976

[21] Appl. No.: 703,621

[52] U.S. Cl. ..... 29/6; 72/384; 72/389; 72/404

[51] Int. Cl.[2] ..... B21K 1/08

[58] Field of Search ..... 29/6; 72/305, 306, 308, 72/311, 364, 377, 404, 406, 389, 316, 384, 385, 399, 416

[56] References Cited

UNITED STATES PATENTS

| | | | |
|---|---|---|---|
| 2,175,156 | 10/1939 | Mummert | 29/6 |
| 2,318,344 | 5/1943 | Urschel | 72/306 |
| 2,555,695 | 6/1951 | Knight et al. | 29/6 |
| 2,653,373 | 9/1953 | Brauchler | 29/6 |
| 2,669,637 | 2/1954 | Pitt et al. | 29/6 |
| 2,676,229 | 4/1954 | Knight | 29/6 |
| 3,385,092 | 5/1968 | Scott | 72/311 |
| 3,628,369 | 12/1971 | Williamson | 72/385 |

*Primary Examiner*—Michael J. Keenan
*Attorney, Agent, or Firm*—Fitch, Even, Tabin & Luedeka

[57] ABSTRACT

Apparatus for forming a multiple throw crankshaft from metal rod in a single forming operation. The ends of the rod are held in axially movable units through which electrical resistance heating to a deformation temperature may be effected. A forming head for each throw is clamped about the rod at a precise location therealong. The forming heads are mounted on individual carriages, which are axially movable along the machine base, and each supports a subcarriage for horizontal transverse movement on the carriage driven by a horizontal cylinder. Each subcarriage supports one of the forming heads plus a vertical cylinder for moving the head transversely up or down. Control means is capable of simultaneously actuating the horizontal and vertical cylinders associated with any individual forming unit to thus achieve composite deforming movement of the forming head in any desired transverse angular direction.

10 Claims, 6 Drawing Figures

11
21
23
#4
#3
#2
#1
95
97
98
99
101
103
105
113
115
117
119
121
123
125
127
129
131
135a
135b
135c
145
13
15
52
83

#1
#2
#3
#4
15°
23
25
73
75
87
85
81
83
19
15
20
29
57
79
37
35
53
63
51
65
77
55
61
59
52
64
71
21
98
111
107
109
103
105

CRANKSHAFT-FORMING APPARATUS AND METHOD

This invention relates to the forming of multi-throw crankshafts from metal rod and more particularly to apparatus for heating of metal rod stock to a forming temperature and then bending the heated rod in different directions to form a crankshaft having a plurality of throws.

It is well known in the prior art to form multiple throw crankshafts by forging operations wherein each particular section of rod or bar stock is heated and bent to form the throw which is parallel to but offset from the axis of the rod. U.S. Pat. Nos. 2,555,695 and 2,676,229 disclose apparatus for electrically heating bar stock and then bending the heated portions to form an offset throw section. More particularly, the earlier patent shows the formation of a crankshaft having a pair of oppositely offset throws which are formed by a single heating of the bar stock and without stretching the rod so as to decrease its cross section. However, the apparatus illustrated is limited to the formation of the crankshaft wherein all of the throws lie in a single plane, unless separate heating, forming and cooling cycles are carried out with some manual adjusting of the rotary positioning of the bar between the performance of such cycles. Moreover, the operation of the illustrated apparatus results in the creation of regions of enlarged cross section adjacent the crank throws which are considered undesirable.

It is an object of the present invention to provide improved apparatus for forming multiple throws in a crankshaft or the like. A further object of the invention is to provide an improved apparatus for the automatic forming of multi-throw crankshafts from an electrically heated metal rod. A further object of the invention is to provide an improved method for forming multi-throw crankshafts from a metal rod in a one-shot, automatic operation regardless of the desired position of the respective throws at any location 360° about the axis thereof. These and other objects of the invention will be apparent from the following detailed description of apparatus embodying various features of the invention and the operation thereof when read in conjunction with the accompanying drawings wherein:

Basically, the invention provides apparatus for forming crankshafts or the like from metal rod which utilizes a plurality of individually movable forming units which are designed to be automatically actuated by a control system to achieve the formation of a multiple throw crankshaft on a one-shot basis. A suitable length of metal rod is electrically heated to its appropriate forming temperature, and a number of forming heads, equal to the number of desired throws, are clamped about the rod at appropriate locations along its length. A pair of end holding units function along with the forming units and move the ends of the rod inward as the forming takes place to prevent any necking-down or reduction in the cross section of the rod as a result of its transverse deformation to create the throws.

The forming units are individually movable relative to one another so that they will move closer to one another in a direction longitudinally along the axis of the rod during the forming operation. The forming units each include a subcarriage which is attached to the piston or ram of a double-acting, horizontally mounted cylinder which can displace the subcarriage either forward or rearward relative to the axis of the rod. The subcarriage carries the forming head which is in turn attached to a depending, vertically disposed double-acting cylinder which displaces the forming head either upward or downward with regard to the axis of the heated metal rod. The pair of end holding units, which are clamped about the ends of the metal rod being formed, can be moved only in a longitudinal direction toward and away from each other by double-acting cylinders and thus define the axial location of the metal rod which will be the ultimate axis of the completed crankshaft. All of the hydraulic cylinders are actuated by a control system and are operated in appropriate sequence to carry out the desired programmed forming operation. Because each of the individual forming units can be moved either upward or downward and either rearward or forward, the simultaneous movement in two such directions, for example, upward and rearward, is available to create a crank throw positioned at any angle out of the 360° spectrum about the axis of the crankshaft.

DESCRIPTION OF PREFERRED EMBODIMENT

Figure 5:
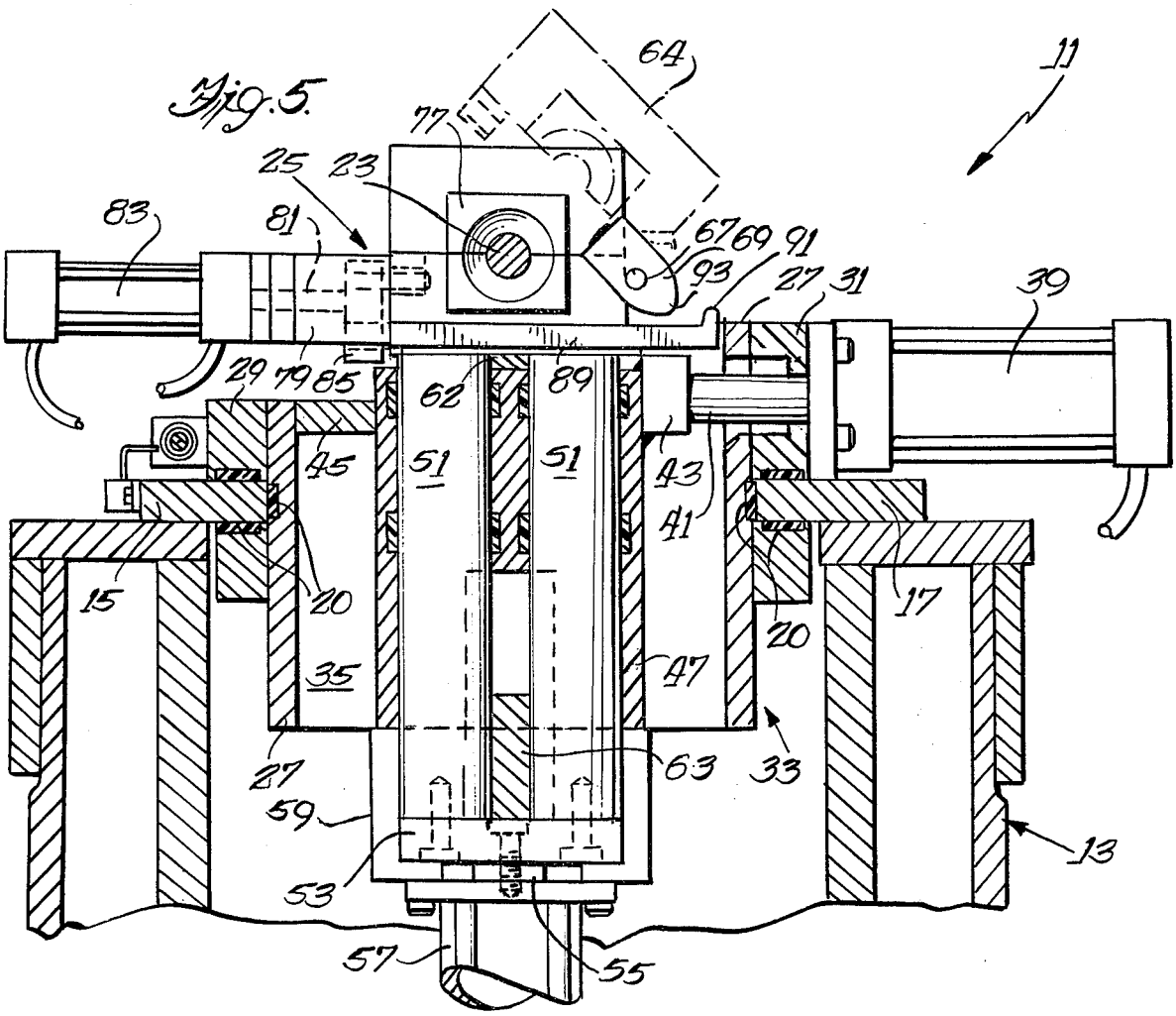
FIG. 5 is an enlarged sectional view taken along the line 5—5 of FIG. 1 with a phantom line illustration showing one of the forming units in the open position.

Forming apparatus 11 is illustrated which includes a bed or base 13 that supports the forming units a desired distance above the floor and within which or upon which the various power and control systems are supported. As best seen in FIG. 5, the bed 13 includes a front rail 15 and a rear rail 17 upon which the individual carriages 19 slide. For this purpose, each of the carriages 19 is provided with bearing strips 20, made of Teflon or some like material which will appropriately reduce the sliding friction at the points of contact between the carriages and the rails and also provide electrical insulation.

In the illustrated embodiment, there are six units which are movable longitudinally along the bed 13, each of which units includes a generally similar carriage 19; however, the two end units are holder units 21 in which the ends of a metal rod 23 to be formed are clamped and which are movable only in an axial or longitudinal direction. The four centrally located units are forming units 25 and are capable of movement in three directions — to wit, axially, either upward or downward, and either rearward or forward. Although the apparatus 11 is illustrated as including only four forming units for purposes of simplicity in description, it should be understood that the invention is particularly well-suited to the use of five or six forming units in order to form crankshafts having up to six throws, because an important advantage of the operation of the apparatus 11 is that any throw on the multiple throw crankshaft can be positioned at any angle about the 360° spectrum. Accordingly, in a five or six-throw crankshaft, the throws will likely not be located at multiples of 99° to one another, and thus the ability to specifically form the throws at any desired angular intervals is especially valuable.

Each of the carriages 19 includes a housing 27 which includes a front plate section 29 and a rear plate section 31, both having surfaces which are milled out to receive the aforementioned bearing strips 20. The central portion of each housing 27 of the forming units 25 is open and provides a region wherein a subcarriage 33 is located. The subcarriages 33 are proportioned to fit within the open region provided by lateral vertical walls 35 which extend between the front and rear plate sections and complete the housing. The subcarriages include an upper plate 37, the side edges of which rest upon the upper surfaces of the lateral vertical walls 35 of the housing for slidable movement therealong. Suitably bolted to the rear plate 31 of each of the four forming units 25 is a horizontally disposed fluid motor, i.e., a double-acting hydraulic cylinder 39 for moving the subcarriage 33 forward and rearward relative to the housing 27 and to the axis of the metal rod being formed. The rear plate 31 and the rear wall of the housing 27 are provided with suitable apertures through which the piston rod 41 of the cylinder 39 extends, terminating in a block 43 which is appropriately affixed, as by welding, to an upper location on the rear wall of the housing. The apertures in the rear wall and rear plate 29 also accommodate the block 43. Accordingly, as best seen in FIG. 5, by the appropriate application of hydraulic pressure to the rear end of the cylinder 39, the piston rod will be extended pushing the subcarriage forward (i.e., to the left). However, the No. 2 forming unit is programmed to be moved downward, and it is arranged to be located in the initial axial position by a pair of shims 45 mounted adjacent the front wall of the housing and against which the subcarriage is driven by the cylinder 39. Alternatively, by the appropriate application of hydraulic pressure to the inward end of the cylinder, retraction of the piston rod 41 will occur, resulting in withdrawing or pulling of the subcarriage 33 rearward (i.e., to the right). If the forming unit were to be moved rearward, the extent of movement of it would be determined by shims 46 mounted upon the rear wall of the housing (see FIG. 6).

Figure 6:
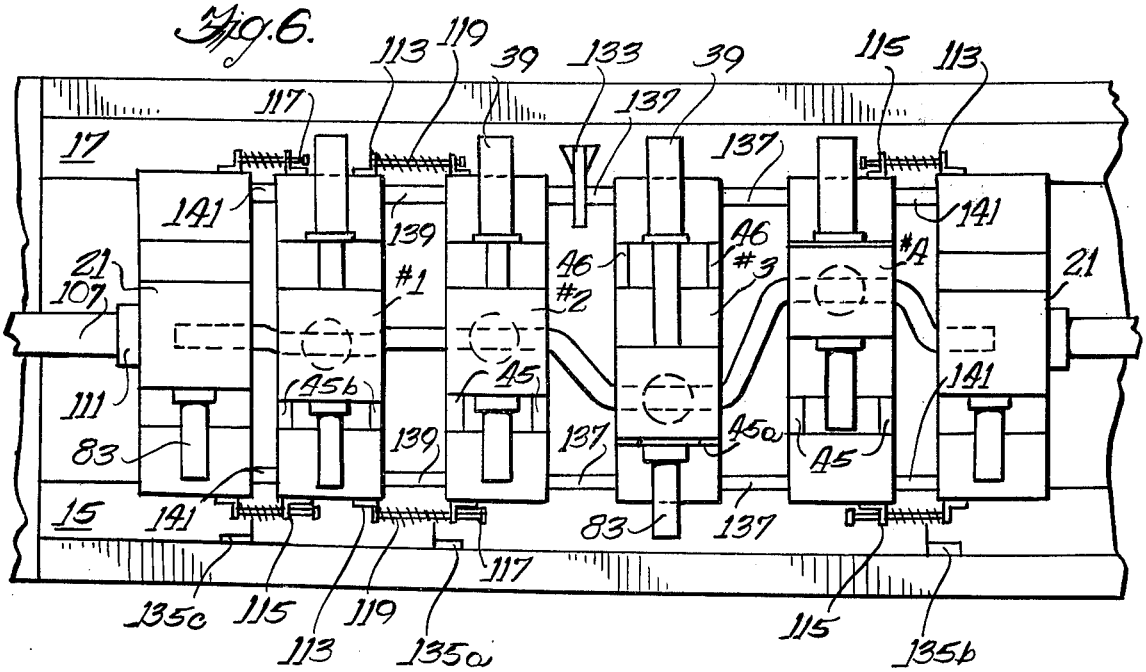
FIG. 6 is a diagrammatic plan view of the apparatus shown in FIG. 1 in the position wherein it has completed the forming operation of the crankshaft depicted in FIG. 2.

In the operation of the apparatus 11, movement of the pistons 41 is always carried out to a mechanical stop so that the full available hydraulic pressure is used in each instance and is maintained on each cylinder until cool-down is completed to assure precision in the ultimate crankshaft is achieved. In this respect, and inasmuch as the No. 2 forming unit is depicted in FIG. 5 wherein the only movement is vertically downward and wherein no horizontal movement of the subcarriage would be employed, hydraulic power is maintained on the outer end of the cylinder 39 throughout the forming operation to keep the subcarriage seated against the shims 45. Where, as in the case of unit No. 3, there is substantial forward movement, the shims 46 establish the initial position, and, as depicted in FIG. 6, when full hydraulic power is provided to the outward end of the cylinder 39, the subcarriage 33 is moved forward until it is manually halted against the much thinner shim stops **45*a* which precisely determine the amount of transverse deformation of the particular throw of the metal rod 23** held by that forming unit.

The upper slide plate 37 of the subcarriage rests on the upper vertical edges of the lateral walls 35 of the carriage housing 27 and is slidable therealong as a result of its interconnection with the horizontal piston 41. Depending from the plate 37 is the body section 47 which is proportioned to move forward or rearward within the otherwise open region provided by the housing 27. A lower plate (not shown) is affixed to the underside of the subcarriage body portion 47 and extends laterally outward to an extent generally coextensive with the lateral walls 35 of the carriage so that the upper surface of the side edges of the lower plate is disposed generally in sliding engagement below the lower edges of the lateral walls, similar to the disposition of the upper plate 37 thereabove (FIG. 5).

A pair of spaced apart parallel vertical bores extend through the upper plate 37, the body portion 47 and the lower plate of the subcarriage 33, and a pair of tie rods 51 are slidably received in these vertical bores. The upper ends of the tie rods 51 support a clamping head 52. The bottom ends of the tie rods 51 are connected to a yoke 53 which is in turn affixed to the upper end of a piston rod 55 which extends upward from a vertically disposed fluid motor, i.e., a double-acting hydraulic cylinder 57. The hydraulic cylinder 57 is mounted via a pair of extension brackets 59 which depend from the front and rear surfaces of the subcarriage body section 47 and contain a lower mounting section which contains tapped holes. The mounting section is spaced a sufficient distance below the undersurface of the central portion of the body section 47 to allow the yoke 53 to travel the full length of the piston stroke between its uppermost and lowermost vertical positions. The body section 47 is cut away between the vertical bores at the lower ends thereof to provide clearance for the yoke 53 on its upward travel.

The vertical movement of the clamping head 52 in response to the depending vertical cylinder 57 is likewise determined by shims appropriately placed on the subcarriage 33. In FIG. 5 the No. 2 forming head is shown, for purposes of illustration, in the lower-most position where it would be at the conclusion of a forming operation. The extent of downward movement in this case is determined by an hourglass-shaped shim 62 which is affixed to the surface of the upper plate 37 of the subcarriage in the region between the pair of tie rods 51. Thus, when the undersurface of the lower half 65 of the forming head abuts the top of the shim 62, vertical movement ceases and the forming head 52 is positively held in this position by the hydraulic pressure which is maintained on the upper end of the double-acting cylinder 57.

At the end of the forming operation after the cooled crankshaft has been removed, the control system shifts all of the solenoid valves on the forming cylinders 39 and 57 to return them to their starting positions. Positive mechanical stops are used to assure precise positioning of the four forming units 25 co-axial with the cavities of the end holder units 21. In this respect, a shim 63 having a height equal to about half the length of the stroke is affixed to the upper surface of the yoke 53 between the pair of tie rods 51, and this shim abuts the undersurface of the body section 47 of the subcarriage when the tie rods and the forming head which they carry reaches its desired starting position. The arrangement is of course reversed when the forming unit 25 is programmed to distend the clamped section of the rod upward. In such instance, in the illustrated version, the No. 1 unit has only a fairly thin shim 63 affixed to the yoke 53, and a much thicker shim 62 is used to determine the starting position.

Each forming unit 25, as well as the two end holding units, includes the clamping or forming head 52 which is split into an upper half 64 and a lower half 65. The lower half 65 is suitably affixed to the upper ends of the two tie rods 51 and thus moves upward or downward in response to the movement of the hydraulic cylinder 57. The upper and lower halves of the clamping head 63 are pivotally connected to each other by a pivot pin 67 which is journalled in a rearward extension of the lower half (see FIG. 5). The upper half 64 of the clamping head carries a pair of apertured lugs 69 which are suitably affixed, as by welding, to the lateral sides of the upper half of each head and depend diagonally downward and rearward therefrom.

Figures 3, 4:
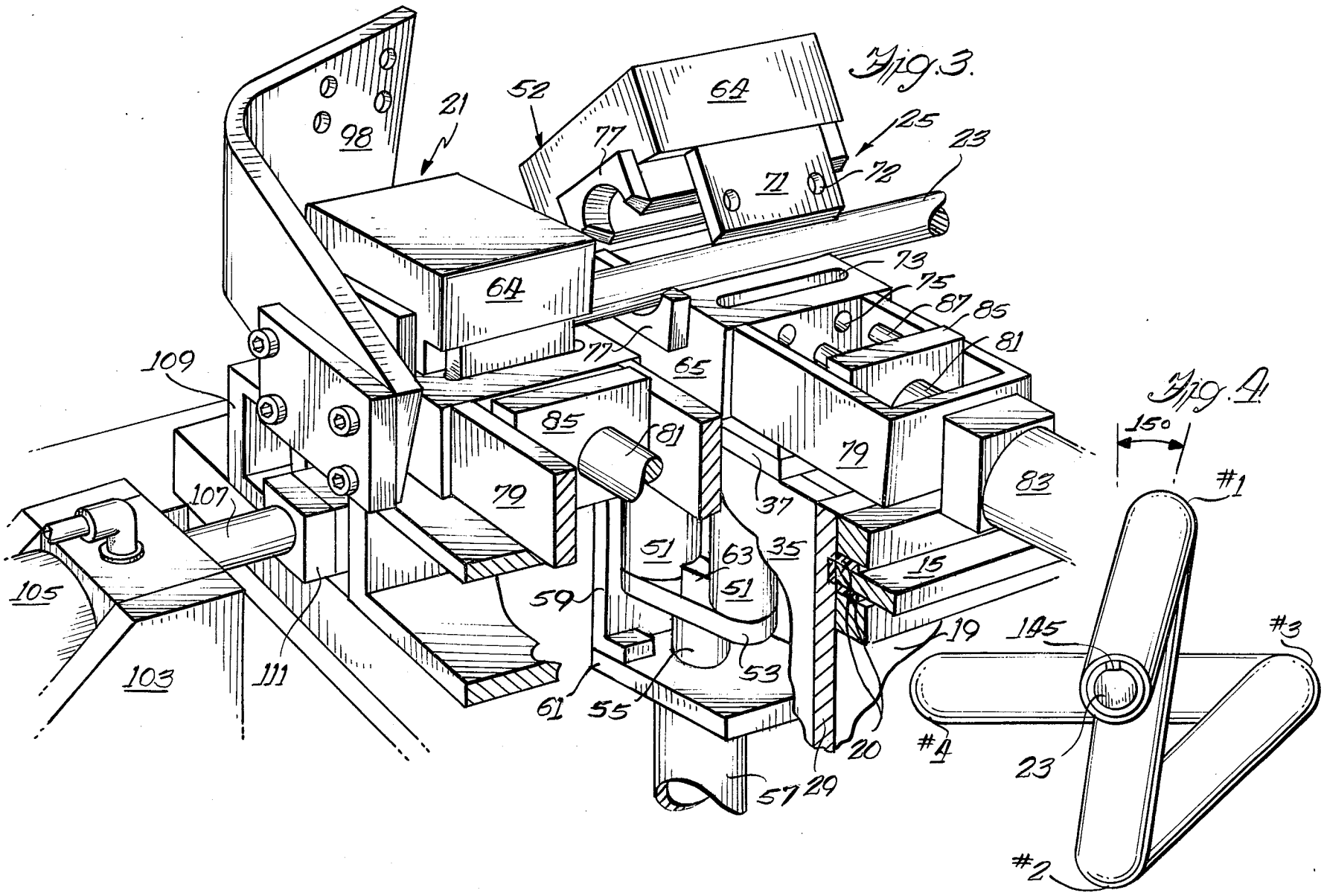
FIG. 3 is an enlarged perspective view of a portion of the apparatus depicted in FIG. 1 showing a metal rod which is clamped in the apparatus for the initial heating operation prior to forming.
FIG. 4 is an enlarged end view of the crankshaft depicted in FIG. 2.

In addition, each of the upper halves 64 includes a tongue 71 at its front end which depends therefrom and which has a pair of spaced-apart holes 72. The tongue 71 is received in a slot 73 provided within the forward portion of the lower half 65 of the head (as best seen in FIG. 3). The lower half 65 also contains a pair of bores 75 which register with the two holes 72 in the tongue 71 when the head is completely shut. Cavities within the upper and lower die halves accommodate a pair of cooperating inserts 77 which are sized to fit snugly about the cylindrical surface of the metal rod 23 being formed, e.g., 1¼ inches in diameter, which inserts are appropriately fixed in place, as by retaining screws (not shown), so as to be interconnected parts of the upper and lower die halves, respectively.

Extending horizontally from and carried by the lower half 65 of each clamping head is a mounting bracket 79 which has a circular bore in its central section to permit passage therethrough of the piston rod 81 of a small, horizontally disposed locking cylinder 83. The small cylinder 83 is also an hydraulic double-acting cylinder, the inward end of which is appropriately mounted to the central portion of the bracket 79. The piston rod 81 is connected to a piston head 85 which is generally square in shape and slidably travels back and forth within the confines of the sidewalls of the mounting bracket 79. The piston head 85 carries a pair of locking pins 87 which are sufficiently long to protrude through the bores 75 in the front wall of the lower half 65 of the head and into the elongated slot 73. The inward ends of the locking pins 87 are chamfered so that the pins will enter the holes 75 in the depending tongue 71 even if they are slightly out of register and pull the upper die half 64 downward into tight engagement with the upper surface of the lower die half 65, thus clamping the pair of inserts 77 tightly about the outer surface of the metal rod 23 residing in the split cylindrical cavity therein.

In order to swing the upper die half 64 about the rear pivot pin 67, a pair of passageways are provided which extend completely through the lower half of the forming head at a location below the cavity wherein the inserts 77 are received. A pair of slide bars 89 reside in the cavities, the forward ends of which are received in slots provided in the lower portion of the piston head 83 and are suitably affixed therein. The two slide bars 89 extend completely through the lower half 65 of the head terminating in a pair of upstanding cams 91. The rear ends of the diagonally depending lugs 69 terminate in a pair of curved ears 93 which are located so as to be engaged by the upstanding cams 91 on the slide bars 89.

When hydraulic pressure is applied to the outward end of one of the locking cylinders 83, the piston rod 81 and piston head 85 are driven to the positions shown in FIG. 5. Gravity causes the upper head half 64 to swing downward during the initial travel of the piston, with the curved ear following the cam 91 rearward. When the upper half 64 is closed and resting upon the lower half 65, the cam 91 disengages from the curved ear 93 and travels rearward to the extended position shown in FIG. 5. It is during this latter stage of movement of the piston rod 81 that the locking pins 87 enter the pair of holes 72 in the tongues 71 and clamp the upper half of the forming head tightly against the lower half.

Conversely, when hydraulic pressure is applied to the inward end of one of the locking cylinders 83, the piston 81 moves to its totally retracted position causing the slide bars 89 to move to the left as shown in FIG. 5. Engagement of the curved ears 93 by the cams 91 occurs just as the locking pins 87 clear the holes 72 in the tongues 71 so that the upper half 64 is free to pivot upward as the cams cause the lugs 69 to rotate about the pivot pin 67. After opening the forming heads 63, hydraulic pressure is maintained on the inward end of the locking cylinders 83 until the next forming operation begins, thus holding the heads open for removal of the formed crankshaft and the insertion of a fresh length of metal rod 23 after the apparatus 11 has been returned to its starting position.

Any suitable method of heating the metal rod 23 to the desired forming temperature, i.e, about 1600° F. to 1800° F., may be used — for example, inductive electrical heating. However, electrical resistance heating is preferred and is used in the illustrated apparatus 11. In this connection, a power supply is provided which includes a transformer which steps down high voltage, for example, 480 volts, to provide about 18 volt single phase AC current. The power supply 95 is connected by a pair of bus bars 97 to curved conductors 98 which are mounted, respectively, on the two end holding units 21. Because the end holding units 21 move toward each other during the forming operation, whereas the bus bars 97 remain stationary, a flexible lead 99 connects the end of each bus bar and the respective curved connector 98. Each of the end holding units 21 is suitably electrically insulated from the bed 13 of the machine, and the clamping heads of the forming units 25 are also suitably electrically insulated so there can be no path to ground through the machine bed.

Figures 1, 2:
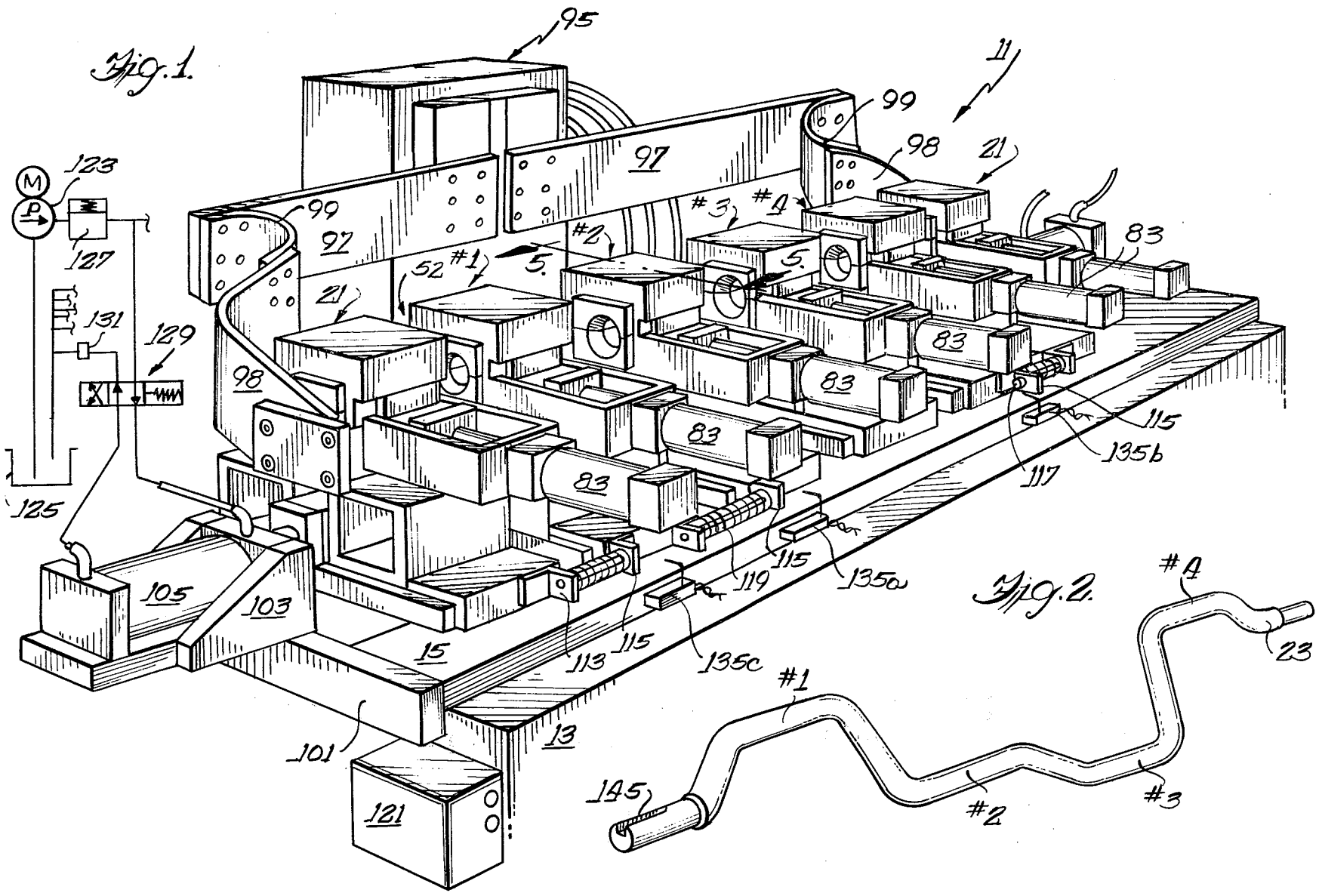
FIG. 1 is a perspective view of forming apparatus for making a multiple throw crankshaft embodying various features of the invention.
FIG. 2 is a perspective view of a multiple throw crankshaft which is illustrative of the crankshafts which can be formed by the apparatus of FIG. 1 as a part of a one-shot forming operation.

As best seen in FIG. 1, each lateral end of the machine bed 13 includes an upper end plate 101 upon which a bracket 103 is mounted which supports a double-acting fluid motor, i.e., a hydraulic cylinder 105, which is mounted so that the piston rod 107 of the cylinder is parallel with the axis of the metal rod 23 being formed.

The carriage 109 of the end holding units is mounted on the front and rear rails 15,17 in the same manner as is the carriage 19 of any of the forming units 25. However, there is no subcarriage, and the clamping head is bolted directly to the carriage, making the carriage simpler in design than the other carriages previously described. The carriage 109 contains a mounting block 111 which receives the end of the piston rod 107 from the cylinder and which thus interconnects the hydraulic cylinder 105 and the end holding unit 21 for motion longitudinally along the machine bed 13.

Although each one of the six units is independently slidable on the machine bed 13, in order to appropriately position all six of the units so that they will be at the desired longitudinal locations along the axis of the metal rod 23 to be formed, some mechanical interconnections are provided between various of the units, which interconnections are duplicated along both the forward and the rearward edges of the carriages 19,109. More particularly, there are mechanical interconnections between the left-hand end holder and forming unit No. 1, between forming units Nos. 1 and 2, and between forming unit No. 4 and the right-hand end holder.

The mechanical interconnections are provided by means of angle iron brackets 113 which have threaded holes which are appropriately used as a part of a pair with angle iron brackets 115 having an aligned, unthreaded hole of slightly larger diameter. A threaded bolt 117 of appropriate length is passed through each unthreaded hole and screwed into the mating threads on the other bracket 113 of the pair. A compression spring 119 is disposed about each bolt 117 in the region between the brackets to keep the individual units spread apart to the maximum distance permitted by the length of the bolt when not under pressure as a result of force being exerted by the hydraulic cylinders 105 at the opposite ends of the machine. Accordingly, the individual units are permitted to move closer together, as desired during the forming operation, because the bolts 117 may slide longitudinally in the unthreaded holes of the brackets 115, compressing the springs 119 as such movement occurs. However, after the cool-down has been completed and the crankshaft removed from the apparatus, reversal of all of the hydraulic cylinders results in the opposed end cylinders 105 retracting, which causes the left and right-end holders 21 to, respectively, drag the No. 1 and No. 4 forming units with them to the desired starting location when the heads of the bolts engage the brackets 115. The No. 1 forming unit in turn drags the No. 2 forming unit along with it.

A control system 121 is provided which, after manual initiation, automates the entire remainder of the forming cycle down through the cool-down of the formed crankshaft. To power the operation of the apparatus, a hydraulic pump and an attached driving electric motor 123 are used to draw hydraulic fluid from a sump 125 and maintain about 2000 psi in a hydraulic reservoir or accumulator 127 which is then available for interconnection to lines to each of the hydraulic cylinders employed. Solenoid-controlled valves 129 are provided with respect to each of the hydraulic cylinders, and the arrangement is such that hydraulic pressure is always being applied to one of the two ends of the hydraulic cylinders whenever the apparatus 11 is being operated. The shifting of the valve 129 by the solenoid switches the connections between the hydraulic supply and drain lines in respect to the opposite ends of the double-acting cylinders, and each of the drain lines, downstream of the valve is provided with a flow control orifice 131. Accordingly, although each of the cylinders is provided immediately with the full approximately 2000 psi hydraulic pressure, the rate of movement of the piston will be regulated by the diameter of the flow control orifice 131 in the drain line and thus great precision in the relative rate of movement of the various cylinders is achieved.

The overall control system 121 is programmed so as to actuate operation of the various cylinders in the desired sequence. In the illustrated arrangement, a reference point is arbitrarily set by the longitudinal location of the No. 3 forming unit, and accordingly the carriage 19 of this unit is appropriately pinned or clamped to the machine bed 13 so as to prevent any longitudinal movement on its part. As will be explained in detail hereinafter, the initial actuation of the control system 121 causes the clamping of the ends of the metal rod 23 in the two end holder units 21 followed by a preheating to a desired temperature. Temperature is measured by an optical pyrometer 133, or any suitable device, which in this arrangment is set to focus on the surface of the rod in the location between Nos. 2 and 3 forming units. The optical pyrometer 133 signals the control system 121, and after preheat has been accomplished and the four locking cylinders 83 on units Nos. 1 through 4 are then actuated so as to clamp the metal bar 23 at the four locations which will constitute the four parallel throws of the ultimate crankshaft.

Heating continues with the metal rod 23 clamped in the four forming heads until the desired forming temperature is reached. At this point, the power supply 95 is electrically disconnected from the apparatus as the heat now in the metal rod is sufficient for the entire forming operation.Simultaneously, one or both of the solenoid valves leading to the horizontal and vertical forming cylinders of the No. 3 unit is shifted causing the forming unit to distend the clamped section of the heated metal rod transversely. Simultaneous with the shifting of the solenoid valve of the No. 3 forming unit, the solenoid valves associated with both of the end holders 21 are shifted, applying hydraulic pressure to the outward ends of both of the opposed cylinders 105 causing the end holders to slide toward each other at a rate precisely controlled by the flow control orifices 131 in the respective drain lines. The No. 1, No. 2 and No. 4 forming units all move longitudinally toward the No. 3 unit because they are firmly clamped about the metal rod 23.

The lugs 115 carried by the No. 2 and No. 4 forming units are used to trip limit switches 135*a* and *b* mounted on the front rail 15 of the machine bed to signal the control system 121 when these units have reached certain predetermined reference locations in their points of inward travel. These limit switches 135 in turn send signals to the control system 121 which actuates solenoid valves 129 connected to the Nos. 2 and 4 forming units to instigate the transverse forming operations of these forming heads. Very shortly thereafter, the lug 115 on the No. 1 forming unit hits a limit switch 135*c* which initiates the transverse forming movement of the No. 1 forming unit.

The final longitudinal position of the five slidable units is determined with respect to the No. 3 stationary forming unit in the following manner. Stops 137 (see FIG. 6) mounted on both sides of the carriage of the No. 3 forming unit mechanically limit the closeness of approach of the Nos. 2 and 4 units thereto. Similarly, stops 139 mounted on the right-hand side of the No. 1 unit limit the closeness of its approach to the No. 2 unit, and stops 141 mounted on the left-hand and right-hand end units 21 limit the closeness of their approach to the Nos. 1 and 4 forming units respectively. In the illustrated arrangement, the control system 121 includes a timing mechanism which causes all six clamping cylinders to be driven to their retracted position a set time after the power supply 95 has been electrically disconnected from the apparatus to halt the heating. Alternatively, the optical pyrometer 133 could be used to read the temperature and open the forming units after a certain cool-down temperature is reached, or some other frame reference could be employed.

The operation of the apparatus is hereinafter described with respect to the making of the four-throw crankshaft illustrated in FIGS. 2 and 4. A suitable piece of cold drawn steel, e.g., round bar stock 1¼ inches in diameter and 72 inches long, is loaded into the apparatus 11 lying in the cavities provided by the inserts 77. The forming cycle is begun by actuating the control system 121 which shifts a solenoid valve to apply hydraulic power to the outward ends of the 2inch locking cylinders 83 for the right-hand and left-hand end holding units 21, initially closing the units and then seating the locking pins 87 in the tongues 71 to mechanically clamp the inserts 77 tightly about the rod 23 and prevent the opening of these two holding units, as shown in FIG. 3. The power supply transformer steps down from about 480 volts to about 18 volts single phase AC which is applied to the two end holding units via the bus bars 97, the flexible leads 99 and the curved connectors 98. The flow of current through the 72inch long piece of bar stock causes it to be resistively heated.

After preheating the rod 23 for about 15 seconds, a timer in the control system 121 causes the upper halves 64 of the four forming units 25 to be automatically closed by shifting a solenoid valve which applies hydraulic power to each of the remaining 2-inch clamping cylinders 83 causing extension of the individual pistons 81 which ultimately seat the pins 87 in the locking tongues 71. Heating continues for about an additional 40 seconds after the clamping heads 52 have been clamped about the desired longitudinal locations on the rod until the desired heat is attained. The optical pyrometer 133 mounted between the forming units Nos. 2 and 3 reads the temperature of the bar stock and signals the automatic control system 121 when a temperature of about 1650° F. is reached.

The signal causes the control system 121 to open a relay which cuts off the power to the transformer and simultaneously actuates the No. 3 forming unit. At all times during the operation, the hydraulic pump 123 is supplying hydraulic fluid to the accumulator 127 as needed to maintain a constant hydraulic pressure of about 2000 psi., which is available and is used to operate all of the hydraulic cylinders, i.e., the 2-inch diameter locking cylinders and the 4-inch diameter forming cylinders. The No. 3 horizontal cylinder 39 pushes the subcarriage 33 forward as a result of shifting the solenoid valve to pressurize the outward end of the cylinder. The carriage of the No. 3 unit is pinned to the bed 13 and does not move axially during the forming operation.

At the same time as the horizontal cylinder 39 is actuated to push the No. 3 forming unit forward, the two end feed cylinders 105 begin to push the two slidably mounted end holder units 21 toward the center. The travel of all of the 4-inch cylinders 39, 57 and 105 is maintained at the desired relative rates via the use of flow control orifices 131 of appropriate size which are inserted in the hydraulic drain lines leading from the cylinders to the sump 125.

As the portion of bar stock which is clamped in the No. 3 forming unit is pushed transversely out of axial alignment to form the No. 3 throw, the carriages 19 which form parts of the No. 1, No. 2 and No. 4 forming units move toward the No. 3 unit so that no stretching of the heated metal rod occurs, and this movement is aided by the opposed end feed cylinders 105. As the No. 2 and No. 4 forming unit carriages slide longitudinally toward the No. 3 unit, the lugs 115 hit limit switches 135*a* and 135*b* mounted on the front rail of the machine bed, which limit switches send signals back to the main control system 121.

Upon receipt of the signal from the limit switch 135*a*, the control system 121 shifts the solenoid valve leading to the vertical cylinder 57 disposed below the No. 2 forming unit causing this cylinder to pull the forming head vertically downward. Downward movement actually begins while the entire carriage 19 is moving longitudinally as a result of the earlier-described pulling of the No. 3 forming unit, assisted by the motion of the horizontal feed cylinders. In all instances, the movement of the horizontal or vertical cylinders is arrested by a mechanical stop or shim, so that the pressure remains on each cylinder, causing that cylinder to hold the distended portion of the bar stock in the precise desired position.

Substantially simultaneously with the forming movement of the No. 2 forming unit and upon receiving the signal from the limit switch 135*b*, the control system 121 causes another solenoid valve to shift to apply pressure to the inward end of the horizontal cylinder 39 for the No. 4 unit to retract the piston rod 41 connected to this cylinder. The retraction of this piston rod pulls the No. 4 unit subcarriage 33 rearward, which motion is directly opposite to that of the No. 3 forming unit.

Just slightly later, the lug 115 mounted on the carriage of the No. 1 forming unit trips limit switch 135*c*, sending a signal to the control system 121. In response, the control system shifts a pair of solenoid valves which cause hydraulic pressure to be applied to the outward ends of both of the horizontal cylinder 39 and the vertical cylinder 57 causing the No. 1 forming head to be moved both forward and upward relative to the axis of the metal rod, as the horizontal end cylinder 105 continues to move the carriage longitudinally. The major movement desired is vertically upward, and flow control orifices 131 are provided to assure that the rate of movement of the piston 55 of the vertical cylinder is faster than the piston 41 of the horizontal cylinder. Mechanical stops are also provided so that the ultimate position of the No. 1 throw is at about 15° on the 360° circle (see FIG. 4), as opposed to 0° if only the vertical cylinder had been actuated.

The longitudinal movement of the carriages 19 on which the Nos. 2 and 4 forming units are mounted is halted when they respectively contact blocks 137 mounted on the opposite lateral sides of stationary unit No. 3. The blocks 139 carried on the right-hand side of unit No. 1 (see FIG. 6) terminates its movement when it contacts the No. 2 unit carriage, and at substantially the same time, the blocks 141 that are affixed to the carriages 109 which form a part of the end-holding units contact the carriages of the Nos. 1 and 4 forming units, halting their further movement.

The forming operation takes place rapidly once the desired heat is attained, and there is only a time lapse of about four to five seconds from the time hydraulic pressure is applied to the No. 3 forming unit until all longitudinal movement of the forming and end holding units is completed. At the end of this time, a timer takes over, and the newly formed crankshaft is allowed to cool for about 60 seconds while full hydraulic pressure is maintained on all of the cylinders. At the end of this period of time, the hydraulic pressure on all six of the locking cylinders 83 is reversed to drive the piston rods 81 to their retracted positions, thus extracting the locking pins 87. Continued movement of the pistons after removal of the locking pins cams the six units open by causing the upper halves 64 to pivot upwards about 60°, in which elevated positions they are thereafter held. The operator then lifts the crankshaft from the apparatus 11 and transfers it to a finishing station wherein ends of the crankshaft are ground and a keyway 145 is milled in one end. Steel rings may also be swaged onto the crankshaft at the center of each throw to complete the fabrication.

After removing the crankshaft, the operator hits a switch which causes the control system 121 to shift the solenoid valves to drive all of the 4-inch cylinders back to their starting position, thereby returning all four of the forming units 25 to their precise original alignment, with the cavities coaxial with the cavities of the two end holding units which have likewise retracted to their initial positions. As earlier indicated, the right-hand end holder drags the carriage of the No. 4 unit back with it, and the left-hand end holder drags the carriage of the No. 1 unit and, in turn, the No. 2 unit carriage back with it. The compression springs 119 assure that overtravel of the forming unit carriages 19 past their desired starting positions on the main slide does not occur.

Overall, the heating, forming and cooling of a 1¼ inch diameter cold drawn steel rod, about 6 feet in length, is carried out in a time of slightly less than 2 minutes, and the throws of the finished crankshaft will meet tolerances of plus or minus about 0.015 inch, which is considered excellent for a crankshaft of this size. The illustrated apparatus can form crankshafts having two, three or four throws. By expanding the length of the bed of the apparatus and adding one, two or three additional forming units, crankshafts having five, six and seven throws can be manufactured which are sufficient to fill the needs of farm and other similar machinery of current design. The present control system 121 is easily expanded, by duplication, to control one, two or three additional forming units. One of the significant advantages of the overall apparatus design and one which permits this natural progression to the formation of a five-, six- or seven- throw crankshaft is that the simultaneous operation of both the horizontal and the vertical push-pull cylinders on any forming unit allows a crank throw to be formed which will be parallel to the axis and which may be located at any angle throughout the entire 360° spectrum, as viewed from the end in FIG. 4

Although the invention has been described and illustrated with respect to a preferred embodiment, it should be understood that various modifications may be made as would be obvious to one having the ordinary skill in this art and such modifications are considered to fall within the scope of the invention which is defined solely by the claims appended hereto. Various of the features of the invention are set forth in the claims which follow.

What is claimed is:

1. Apparatus for forming crankshafts from metal rod, including a base, a pair of units for holding a metal rod to be formed at locations near the ends thereof, which holding units are movable in a direction axially of the rod, means for electrically heating the metal rod to a temperature sufficient to permit its deformation, a plurality of forming units which include forming heads designed to be clamped about the rod at precise locations therealong between said holding units, means for moving said forming heads in a direction transverse to the axis of the rod and control means for moving said forming heads of different units in different directions, wherein the improvement comprises said forming units being mounted on individual carriages which are axially movable along said base, each of which carriages supports a subcarriage for movement on said carriage along a first line transverse to said axis plus a first motor for so moving said subcarriage, each of said subcarriages supporting one of said forming heads plus a second motor for moving said head along a second line transverse to said axis with the direction of movement along said second line being generally perpendicular to the direction of movement along said first line.

2. The invention in accordance with claim 1 wherein said control means is designed to simultaneously actuate said first and second motors of one of said forming units to thus achieve composite movement of said forming head transverse to said axis in a direction lying between said first and second lines.

3. The invention in accordance with claim 2 wherein said motors are each capable of creating movement in either of the two opposite directions along said respective line.

4. The invention in accordance with claim 3 where said first and second motors are double-acting fluid cylinders.

5. The invention in accordance with claim 4 wherein said first cylinder moves said subcarriage horizontally and wherein said second cylinder moves said forming head vertically relative to said subcarriage.

6. The invention in accordance with claim 4 wherein said cylinders are hydraulic cylinders, wherein said control system applies substantially the same hydraulic pressure to all cylinders which are being operated, and wherein the rate of operation of said cylinders is controlled by controlling the rate of flow of hydraulic fluid from the opposite end of each such cylinder.

7. The invention in accordance with claim 5 wherein additional double-acting fluid cylinders are also connected to said pair of holding units and wherein said control system operates said additional cylinders simultaneously with said first and second motors.

8. The invention in accordance with claim 2 wherein said forming heads have cavities for clamping onto the metal rod which are provided with interchangeable inserts to receive rods of different size, wherein said heads are split and said split head sections are pivotally connected to each other and wherein said forming heads each include a further fluid motor for pivoting said sections closed and for locking said sections in said closed condition.

9. A method for forming crankshafts from metal rod, which method comprises heating the metal rod to a temperature sufficient to permit its deformation while it is supported at locations near the ends thereof in a pair of holding units which are movable in a direction axially of the rod, clamping a plurality of forming heads about the rod at precise locations therealong, actuating fluid-operated cylinders associated with each of said forming heads to move said head in a direction transverse to the axis of the rod, and controlling said movement so that different forming heads move in different directions and so that, in the case of at least one forming head, first and second fluid cylinders are simultaneously actuated, which first and second cylinders are aligned generally perpendicular to each other so that composite movement of said forming head is achieved in a direction between the directions of straight-line movement of said first and second cylinders respectively.

10. A method in accordance with claim 9 wherein double-acting hydraulic cylinders are employed and the rate of movement of each cylinder is controlled by controlling the rate of exit flow of hydraulic fluid from the opposite end of each cylinder.

* * * * *